US006046675A

United States Patent [19]

Hanna

[11] Patent Number: 6,046,675

[45] Date of Patent: Apr. 4, 2000

[54] MAIL DELIVERY INDICATOR DEVICE

[76] Inventor: Robert L. Hanna, 2602 37th St., Rock Island, Ill. 61201

[21] Appl. No.: 08/783,618

[22] Filed: Jan. 14, 1997

Related U.S. Application Data

[63] Continuation-in-part of application No. 08/475,808, Jun. 7, 1995, abandoned.

[51] Int. Cl.[7] ..... G08B 13/14

[52] U.S. Cl. ..... 340/569; 200/61.52; 340/689

[58] Field of Search ..... 340/569, 689, 340/693, 539, 545; 200/61.45 R, 61.52, 61.63; 33/365, 366; 232/35–37

[56] References Cited

U.S. PATENT DOCUMENTS

| | | | |
|---|---|---|---|
| 3,150,361 | 9/1964 | Conigliaro | 340/569 |
| 3,440,603 | 4/1969 | Cochran | 200/61.45 R X |
| 4,154,393 | 5/1979 | Darvishian | 340/569 X |
| 4,868,543 | 9/1989 | Binkley | 340/569 |
| 4,872,210 | 10/1989 | Benages | 340/569 |
| 5,023,595 | 6/1991 | Bennett | 340/569 |
| 5,239,305 | 8/1993 | Murphy et al. | 340/569 X |

*Primary Examiner*—Thomas J. Mullen, Jr.

*Attorney, Agent, or Firm*—Rockey, Milnamow & Katz, Ltd.

[57] ABSTRACT

A mechanism for indicating the deposit of mail in a mailbox comprising a tilt switch mountable to either surface of the mailbox door. As the door is opened past a particular point, the tilt switch completes a circuit which sends a signal to a receiver which activates an alarm indicating that mail has been deposited in the mailbox.

12 Claims, 7 Drawing Sheets

Fig. 6
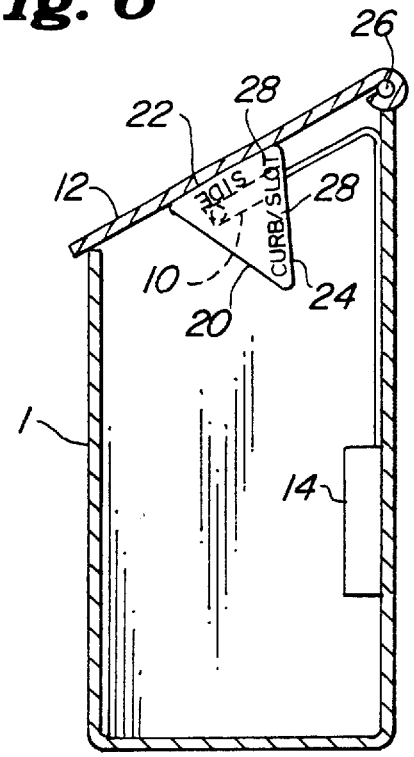
Fig. 7
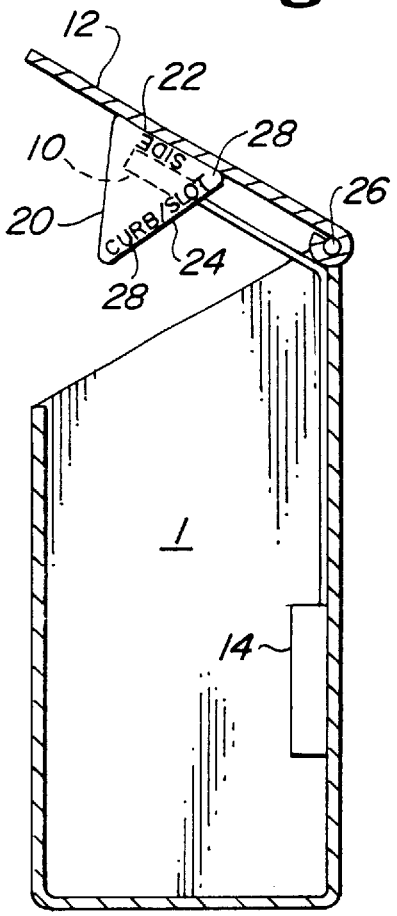
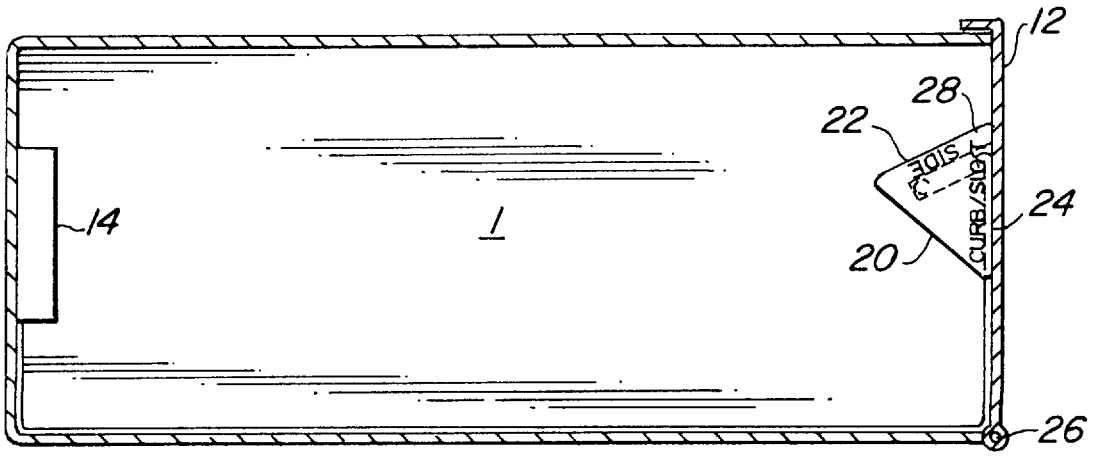
Fig. 8

Fig. 9
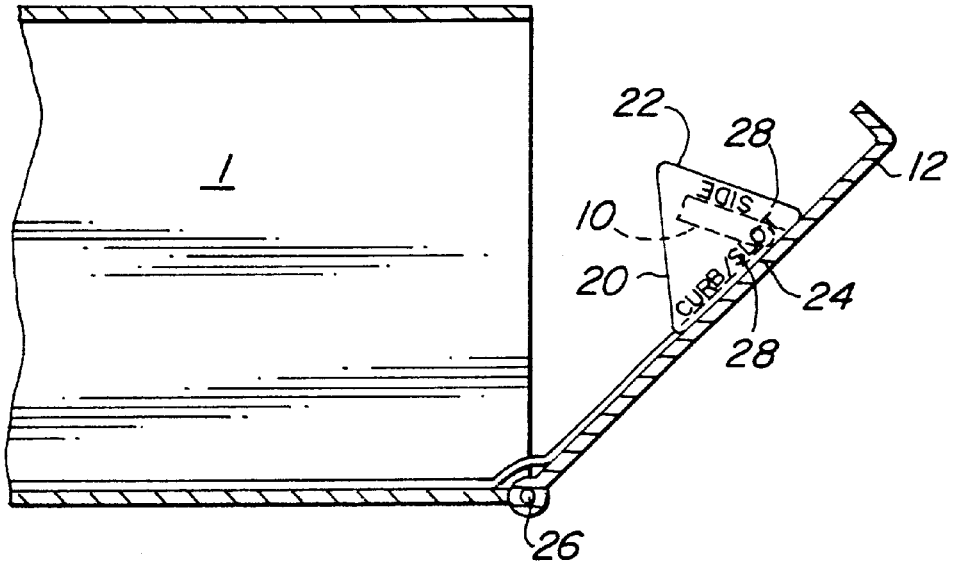
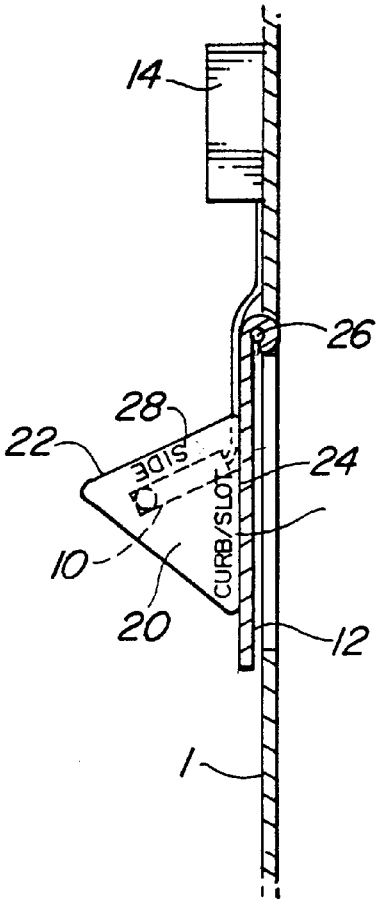
Fig. 10
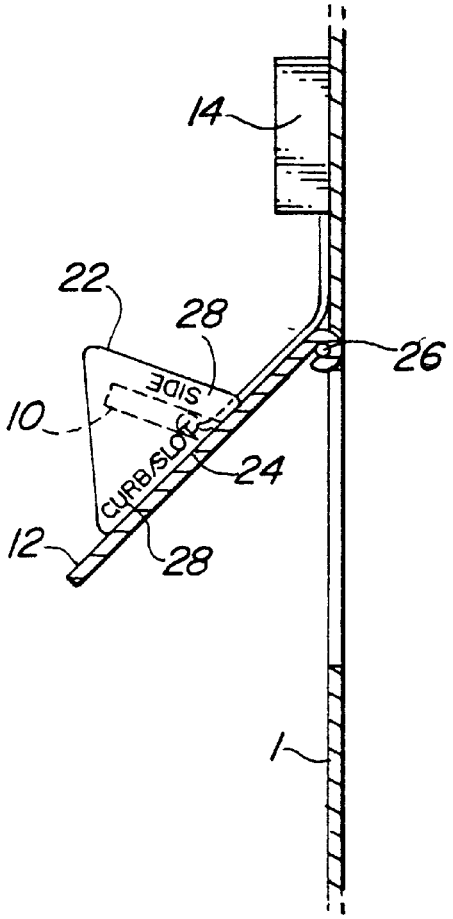
Fig. 11

MAIL DELIVERY INDICATOR DEVICE

This is a continuation-in-part of application Ser. No. 08/475,808 filed on Jun. 7, 1995 now abandoned.

BACKGROUND OF THE INVENTION

1) Field of the Invention

This invention relates to devices which indicate when mail has been deposited in a mailbox.

2) Related Art

Many efforts have been made in the past to devise a mechanism that signals when mail has been deposited in a mailbox. It is common for mailboxes to be positioned somewhat remote from the residence or business such that the recipient of the mail must make a special trip to the mailbox to check whether the mail has arrived yet or not. These signalling devices are designed to eliminate any special trips to the mailbox by signalling to the recipient when the mail has arrived.

A first type of prior art which signals the arrival of mail is the mechanical triggering type device. These devices typically sensed opening and closing of the mailbox door by the mailman. A typical mechanical trigger device is shown in U.S. Pat. No. 4,520,350, which has a button which is depressed in abutment with the closed mailbox door. As the door opens away from the button, a spring presses the button outwardly. The button triggers an electrical signalling system when the button springs outwardly in response to the open door. The button mechanism is mounted to the inside wall of the mailbox and must be precisely positioned to properly engage the close door of the mailbox. Existing mailboxes are built in a wide variety of different structural designs and dimensions, and therefore conventional mechanical triggering mechanism which are mounted to an interior wall portion of the mailbox, such as the device of U.S. Pat. No. 4,520,350, cannot be easily installed in a wide variety of differently designed mailboxes. For example, typical mechanical triggering mechanisms are not adapted for use with mailboxes having slot-type openings with doors that pivot inwardly about a high pivot axis. Conventional mechanical triggering mechanisms as described in the prior art are only usable with a narrow range of mailbox designs and dimensions. In addition, these devices are unreliable, costly, and requires individual mounting modifications. These devices are not well adapted for mounting to different types and sizes of existing mailboxes. Therefore, a purchaser of a conventional mechanical triggering mechanism might have to replace his or her mailbox in order to use a particular system. These mechanical devices are generally not compact, and therefore do not fit easily into tight spaces such as a small mailbox.

Another type of device for signalling the arrival of mail is a photoelectric triggering device. The presence of letters within the mailbox blocks light from contacting a photoelectric sensor, which then triggers an electric signalling system. Photoelectric sensors tend to be relatively expensive. These devices must be mounted within the mailbox in particular configurations to utilize the light beam, and therefore the operability of these systems is dependent upon the design and dimensions of the mailbox. In other words, a particular conventional photoelectric device may not function properly or even operate in mailboxes having different structures and dimensions. A purchaser of a photoelectric device may be required to also purchase a new mailbox that is compatible with the device.

Therefore, it is desirable to provide a simple and inexpensive mechanism for signalling when mail has been deposited in a mailbox. It would be desirable for such a mechanism to be easily mountable within a variety of different types of mailboxes having a wide range of designs, shapes, and dimensions. It would also be desirable for such a mechanism to be simple to install and operate.

BRIEF SUMMARY OF THE INVENTION

The present invention provides a tilt switch mounted within a bracket which is mounted directly to either surface of a mailbox door. As the mailbox door pivots from its closed position, the tilt switch senses the opening of the door when the door pivots a certain number of degrees from the closed position. The tilt switch is held at approximately a 25°–30° angle from the horizontal in the closed door position, and will be engaged when the door is opened approximately 30°.

When the tilt switch is engaged, the transmitter sends a brief signal to the receiver, which emits signals which notify the resident that mail has been deposited in the mailbox. The present invention is adapted for use with a curb type mailbox having a door which pivots about an axis located near the bottom portion of the door, and also a slot type mailbox having a door which pivots about an axis near the top portion of the door.

The tilt switch mechanism of the present invention is adapted for use with many different types of mailboxes, including curb type mailboxes and slot type mailboxes. The tilt switch mounts directly to the door of the mailbox, and therefore is not dependent on the mailbox being a particular size, shape, or design. There is therefore, no need to buy a new mailbox to use the present invention with, it can be utilized with the existing mailbox of a residence.

Another alternative embodiment provides a tilt switch holder having first and second side portions that extend at approximately a sixty-five degree angle to one another. The tilt switch holder according to this alternative embodiment is triangular in shape and includes a third side portion adjacent the first and second sides. The tilt switch holder is adapted to be mounted to the door of either a side mount, curbside, or slot type mailbox. When mounted to the side mount door, the first side can be mounted to abut either the inside or outside surface of the door. When mounted to a curbside type mail container, the second side of the holder can be mounted to the inside surface of the door. If it is desirable to mount the tilt switch holder to the outside surface of the door of a curbside mailbox, the third side of the tilt switch can be mounted to the outside of the door. When mounted to a slot type mail container having a door that pivots outwardly, the third side of the holder can be mounted to the inside surface of the door. If it is desirable to mount the tilt switch holder to the outside surface of a door of a slot type mailbox whose door opens outwardly, the second side of the tilt switch holder can be mounted to the outside surface of the door. When mounted to a slot type mail container having a door that pivots inwardly, the second side can be mounted to the inside surface of the door. Lettering can be provided which appears on the tilt switch holder to help identify to an installer which side should be fixed to the door depending on the type of mailbox it is being mounted to. As the doors open, the tilt switch pivots past horizontal, which triggers the signalling mechanism. This switch holder therefor provides a single, low cost device that can be easily installed in a variety of different types of mailboxes.

The present invention is easy to install since the tilt switch is merely mounted to the door with adhesive, double faced tape or some other suitable mounting means. The tilt switch and bracket are compact and can be mounted to relatively small mailbox doors, even narrow slot doors. The present invention is also relatively low cost, in part, because the triggering mechanism includes a common tilt switch and a relatively simple bracket which require little effort in the way of assembly.

DESCRIPTION OF THE DRAWINGS

FIG. 6 is a side view of a side mount mailbox with a tilt switch holder according to an alternative embodiment of the present invention mounted to the closed door.

FIG. 7 is a side view of the side mount mailbox and tilt switch holder of FIG. 6 with the door open.

FIG. 8 is a side view of a curbside mailbox with the tilt switch holder according to the alternative embodiment of FIGS. 6 and 7, and with the tilt switch holder mounted to the closed mailbox door.

FIG. 9 is a side view of the curbside mailbox and tilt switch holder when the door is open.

FIG. 10 is a side view of a slot type mail container with the tilt switch holder according the alternative embodiment of FIGS. 6–9, and with the tilt switch holder mounted to the closed mail slot door.

FIG. 11 is a side view of the slot type mail container and tilt switch holder when the slot door is open.

DETAILED DESCRIPTION OF THE INVENTION

Figure 1:
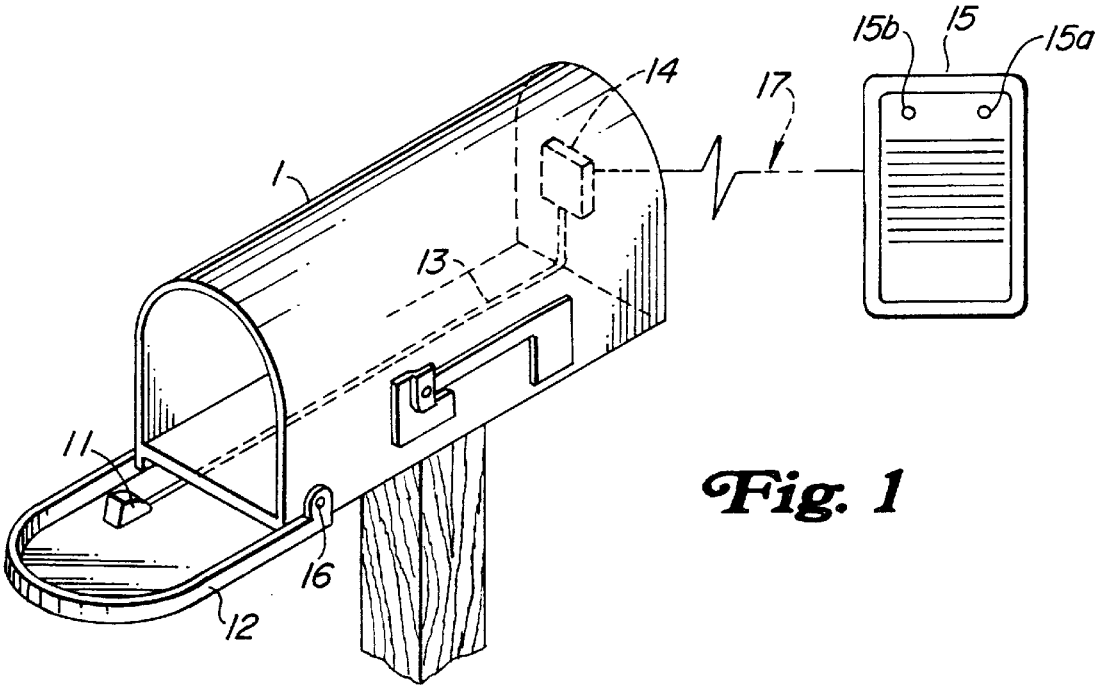
FIG. 1 is an isometric view of a total system.
Figure 2:
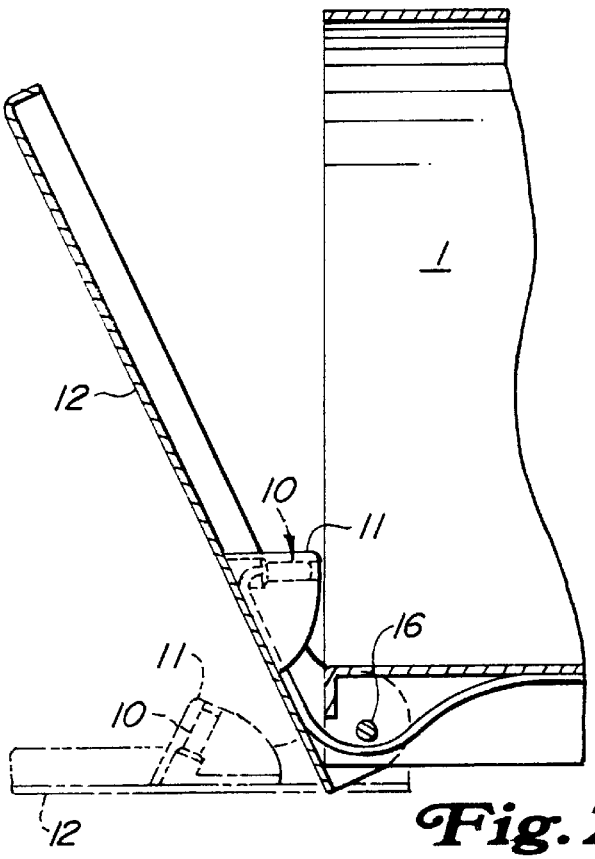
FIG. 2 is a side view of tilt switch attached to open door.

Referring now to the drawings, there is shown the preferred embodiment of the present invention. FIG. 1 shows a schematic view of the three main components of the present invention. The first component is a tilt switch 10 held within a bracket 11 which is fixed to a mailbox door by adhesive, double faced tape or other suitable means. As a mailman pivots the door 12 from its vertical position, the tilt switch 10 mounted to the door completes the circuit 13 when the door has pivoted a certain number of degrees, such as 30° from the vertical closed position. When the circuit 13 is completed by the tilt switch 10, the second component, the transmitter 14, emits a short signal which is received by the third component, the remote receiver 15.

The circuit 13 and transmitter 14 are of conventional construction well known to those skilled in the art, and may be similar to conventional garage door openers. When the signal 17 from the transmitter 14 is received, the receiver 15 sounds a brief audible alarm 15*c*, and engages a visual alarm 15*a*. The receiver 15 and its electronic circuitry are also of conventional design well known to those skilled in art. The light 15*a* signals that the door 12 has been opened, which indicates that mail may be present in the mailbox 1. The light 15*a* remains on until the resident resets the receiver 15 by depressing reset button 15*b*. If the mailbox door 12 is opened when the light 15*a* is already on, the audible alarm 15*c* will again briefly sound and the light 15*a* will remain on until the reset button 15*b* is reset. During operation the transmitter 14 can be positioned anywhere near the mailbox 1, and the receiver 15 can be positioned anywhere within a convenient location in the home or business.

Figure 3:
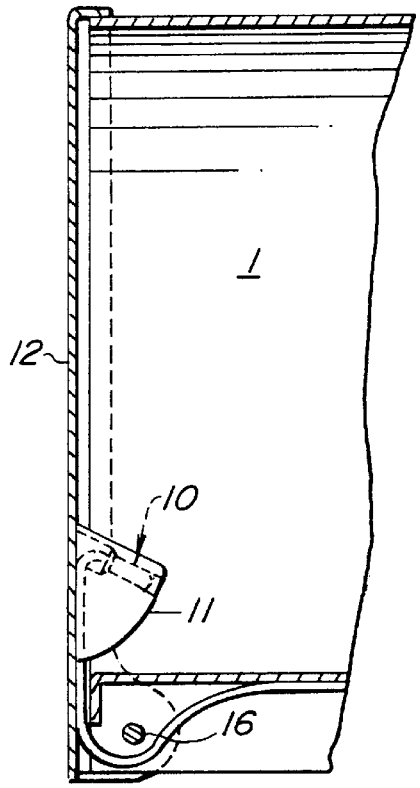
FIG. 3 is a side view of tilt switch attached to closed door.
Figure 4:
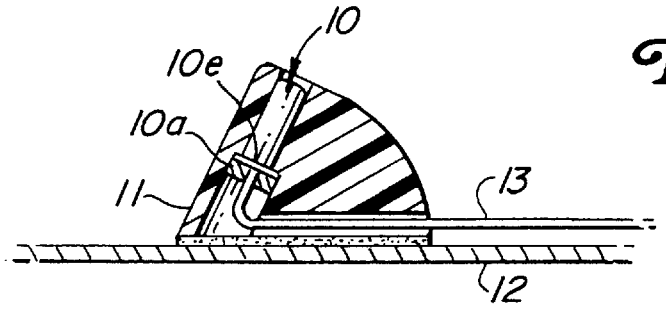
FIG. 4 is detail of tilt switch attached to door.

Next, the tilt switch 10 and bracket 11 of the present invention will be described in greater detail. Referring to FIGS. 3 and 4, there is shown a tilt switch 10 and bracket 11 adapted for use with a curb type mailbox. A curb type mailbox is a type of mailbox common in rural areas, as well as city residential areas, and includes a rounded top portion and a door 12 that pivots open away from the mailbox 1 about an axis 16 located near the bottom edge of the door 12. The bracket 11 includes first and second bores 10*a* and 10*b* having different inner diameters. During assembly, the tilt switch 10 is slid through the larger second bore 10*b* until the tilt switch 10 is fully received within the smaller first bore 10*a*. Adhesive 10*d* can then be applied inside bore 10*b* to the tilt switch 10 where the wires enter. Adhesive will hold the tilt switch 10 firmly in position.

During operation, the curb type mailboxes' door is in a vertical position when closed. The tilt switch 10, which is of conventional construction such as a mercury type switch, is well known to those skilled in the art, and is held at approximately a 30° angle from the horizontal when the door 12 is closed. Once past a predetermined horizontal position, the fluid mercury in the tilt switch 10 will begin to flow toward the flange 10*e* in a manner well known in the art, to complete the circuit. When the tilt switch 10 completes the circuit, the transmitter 14 sends a signal to the receiver which then alarms the resident that the door 12 has been opened for the deposit of mail.

Figure 5:
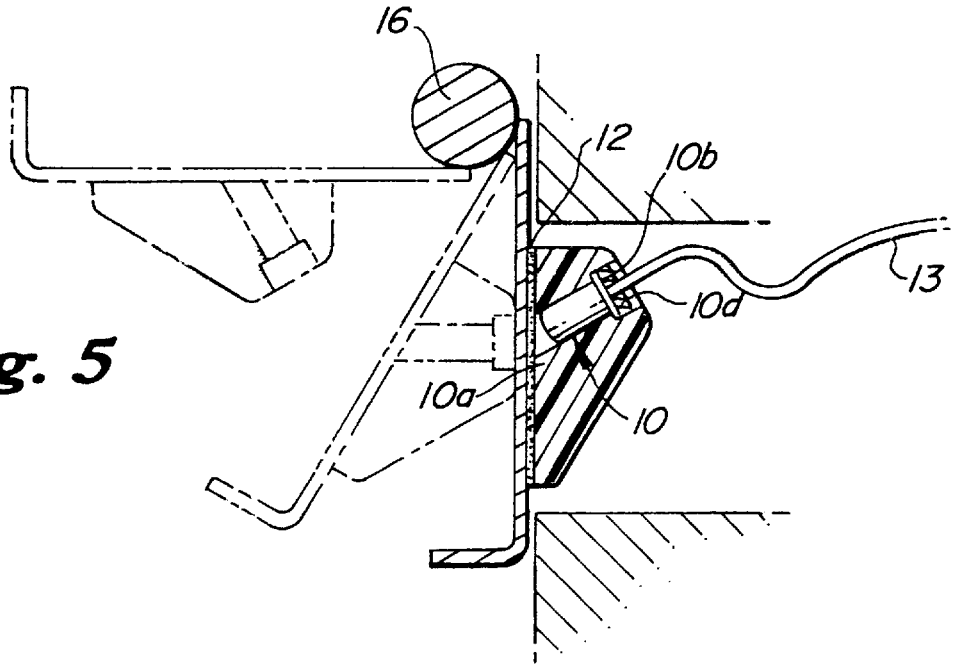
FIG. 5 is tilt switch attached to vertically open door of a slot type mailbox.

Referring now to FIG. 5, there is shown a tilt switch 10 and bracket 11 adapted for use with the slot type mailbox. The door 12 of the slot type mailbox pivots open from its vertical closed position about an axis 16 located near the top of the door and above the slot.

There is a third type of bracket, not shown, which may be adapted for holding a tilt switch 10. The bracket may include first, second and third bores. The tilt switch 10 is held within the first bore during operation until activated by movement similar to that described above.

Figure 12:
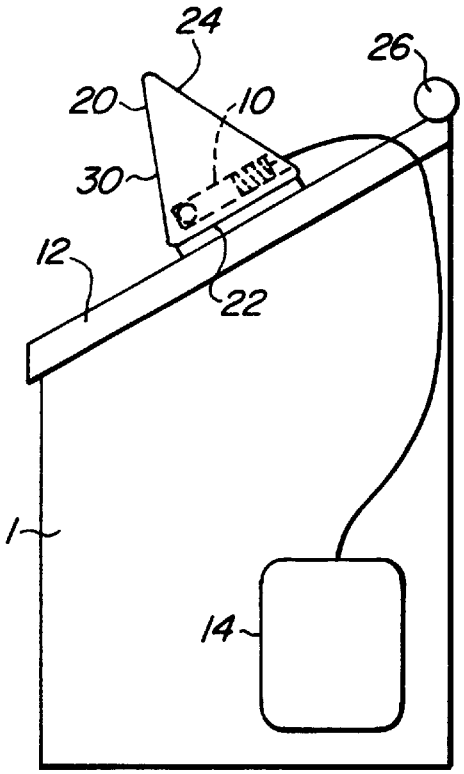
FIG. 12 is a side view of a side mount mail container having the first side of the tilt switch holder mounted on the outside surface of the door with the door in a closed position.
Figure 13:
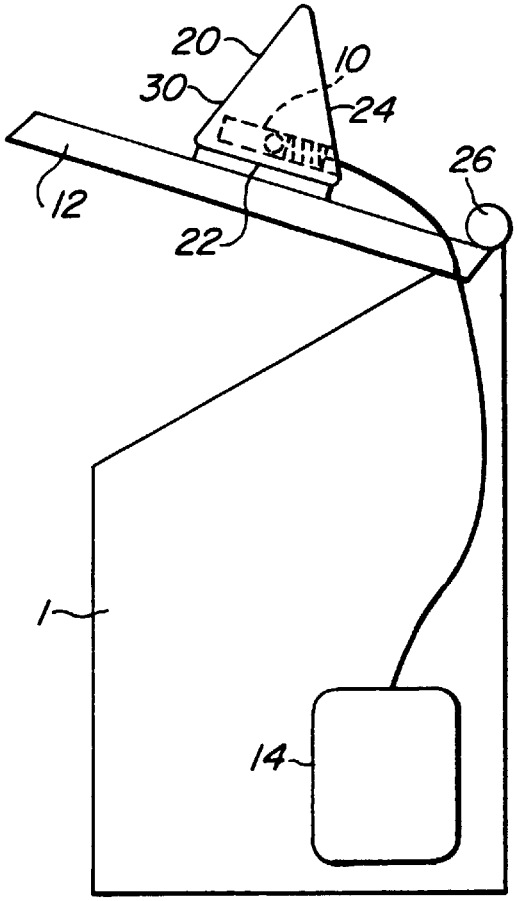
FIG. 13 is a side view of the side mount mail container of FIG. 12 with the first side of the tilt switch holder mounted to the outside surface of the door showing the door open.

Referring now to FIGS. 6–11, there is shown an alternative embodiment of the present invention which is readily adapted for use with three different types of mail containers. A tilt switch holder or bracket 20 having first and second side portions 22 and 24 receives a mercury type tilt switch 10 generally aligned with the first side portion 22. As seen in FIG. 6, the first side portion 22 is adapted to be fixed such as by two-sided tape to the inside surface of the door 12 of a side mount type mailbox 1. Side mount mailboxes typically include doors that are positioned at approximately a thirty or thirty five degree angle to the horizontal in the closed position. The door 12 pivots upwardly about a hinge mechanism 26 to open the side mount mailbox 1 and expose the contents for removal. When the door 12 is closed, the tilt switch 10 remains open, but as the door 12 opens to the position shown in FIG. 7, the mercury in the tilt switch 10 flows to the opposite side of the switch 10 under the force of gravity and thereby completes the circuit. The transmitter 14 will then send a signal to the remote receiver or alarm mechanism 15 as described above, and the recipient of the mail will be informed that the door 12 has been opened. As shown in FIGS. 12 and 13, the first side portion 22 of the tilt switch 20 can also be mounted to the outside surface of the door 12 of the side mount mailbox 1.

Figure 15:
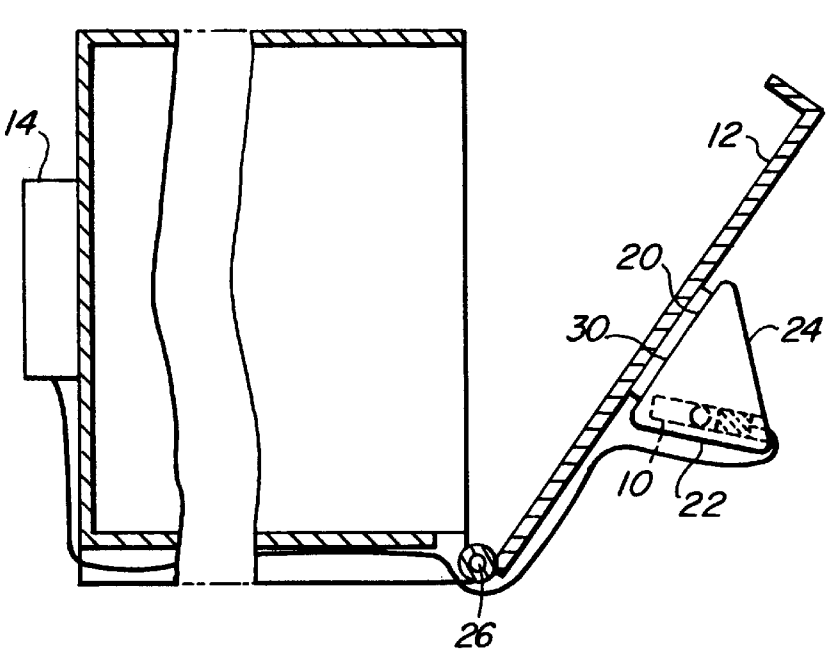
FIG. 15 is a side view of the curbside mailbox and tilt switch holder of FIG. 14 with the door in the open position.
Figure 14:
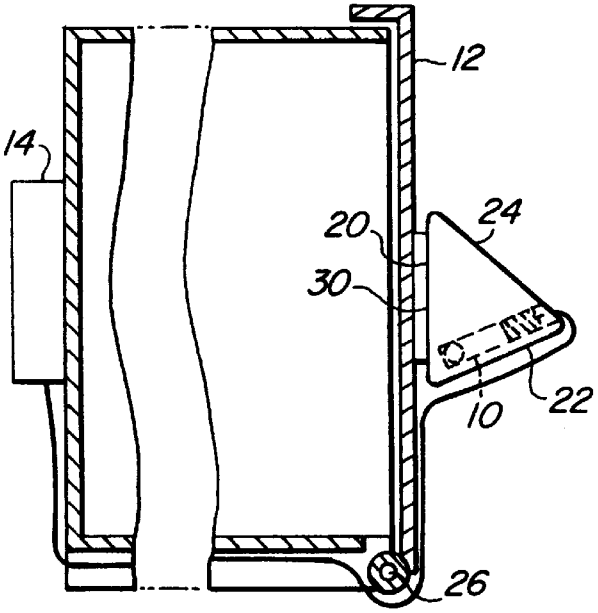
FIG. 14 is a side view of the curbside type mail container having the third side of the tilt switch holder mounted on the outside surface of the door showing the door in the closed position.

Referring to FIGS. 8 and 9, the second side 24 of the tilt switch holder 20 is there shown mounted with the inside surface of a curbside type mailbox 1. Curbside type mailboxes typically include a door that extends vertically when in the closed position. When the door 12 is closed, as shown in FIG. 8, the mercury switch 10 according to the present invention is open. As the door 12 opens to the position shown in FIG. 9, the door 12 pivots outwardly about a hinge mechanism 26 located near the bottom of the door 12. As the door 12 opens and pivots outwardly, the mercury will flow under the force of gravity to the other side of the switch 10 when the door 12 has pivoted approximately twenty-five to thirty degrees from its closed vertical position. As the mercury flows to the other side of the switch 10, the circuit is completed through wire 13 which causes the transmitter 14 to transmit signal 17 to the receiver 15, thus activating the visual light 15*a* and audio 15*c*, to notify the recipient that the mailbox door 12 has been opened. As shown in FIGS. 14 and 15, the third side 30 of the tilt switch 20 can also be mounted to the outside surface of the door 12 of the curbside mail container.

Figure 18:
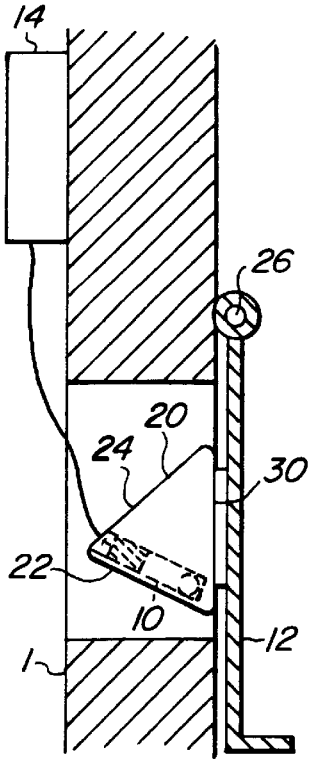
FIG. 18 is a side view of a slot type mailbox whose door opens outwardly showing the third side of the tilt switch holder mounted to the inside surface of the closed mailbox door.
Figure 19:
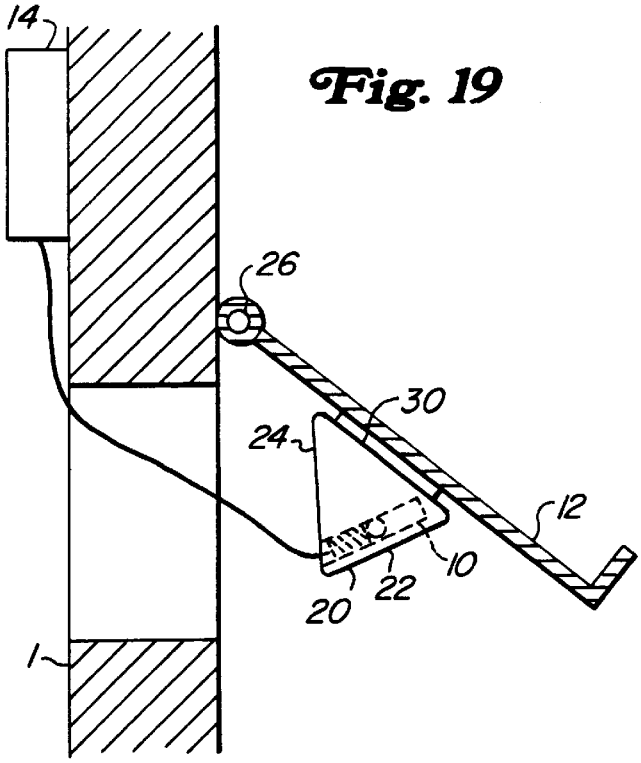
FIG. 19 is a side view of the slot type mailbox and tilt switch holder of FIG. 18 showing the door in an open position.
Figure 16:
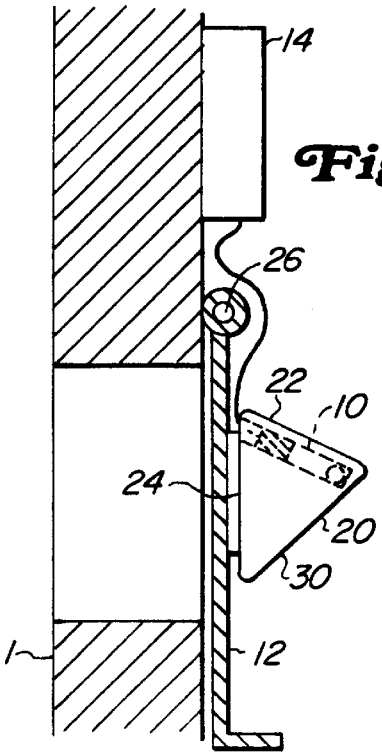
FIG. 16 is a side view of a slot type mailbox whose door opens outwardly, showing the second side of the tilt switch holder mounted to the outside surface of the closed mailbox door.
Figure 17:
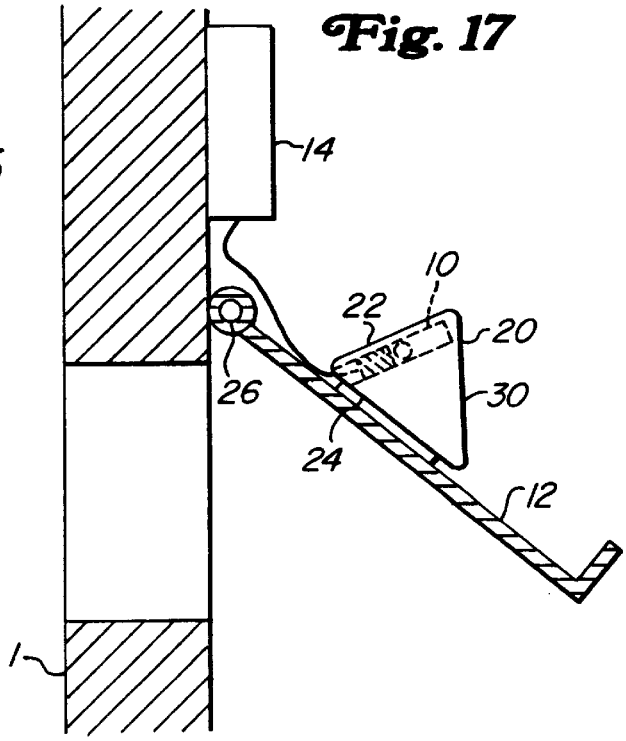
FIG. 17 is a side view of the slot type mailbox and tilt switch holder of FIG. 16 showing the door in an open position.

Referring to FIGS. 10 and 11, the second side of the tilt switch holder 20 is shown mounted with the interior surface of a slot type mailbox door 12 that pivots inward. Slot type mailbox doors typically extend vertically when in a closed position, as shown in FIG. 10. When the door 12 is closed, the mercury tilt switch 10 according to the present invention is open. As the door 12 opens, the door 12 will pivot about a hinge 26 located near the top of the door 12. As the door 12 opens and pivots to the position shown in FIG. 11, the mercury in the switch 10 will flow under the force of gravity to the other end of the switch 10, thereby completing the circuit which causes the transmitter 14 and receiver 15, by means of visual light 15*a* and audio 15*c*, to notify the recipient that the mailbox door 12 has been opened. As shown in FIGS. 16 and 17, the second side 24 of the tilt switch 20 can also be mounted to the exterior surface of a door 12 of a slot type mail container 1 whose door 12 opens outwardly. FIGS. 18 and 19 show the third side 30 of the tilt switch holder 20 mounted to the inside surface of the door 12 of slot type mail container 1 whose door 12 opens outwardly.

The switch holder 20 shown in FIGS. 6–11 is provided with visual indicators or lettering 28 on one side to identify which surface 22 or 24 should abut the inside surface of the door 12 of the three different types of mail containers 1 shown in FIGS. 6–11. The first side 22 abuts the inside surface of the door of the side mount type of mailbox, and therefore "SIDE" or some similar designation is printed on the switch holder 20 near that side edge 22. The second side 24 abuts the inside surface of the curbside and slot type mailbox doors. Therefore, "CURB/SLOT" or some similar designation is printed on the switch holder 20 near that side edge 24. The visual indicators or lettering 28 appearing on the switch holder 20 helps the installer know which side surface to apply or affix to the door of the mailbox depending on which type of mailbox the mechanism is being installed.

The present invention provides a substantially triangular shaped switch holder 20 having first and second sides 22 and 24 that extend at approximately sixty-five degrees to one another and a third side to complete the triangle. An angle of this general magnitude allows a single mechanism and switch holder to be adapted for use with the three different types of mailboxes when the proper side of the switch holder is affixed to either side of the mailbox door. The angle allows the switch 10 to be held at an angle of approximately 30° to the horizontal when mounted to the closed slot or curbside type mailbox doors shown in FIGS. 8, 10, 14, 16 and 18. As the door is opened the switch will then pivot past the horizontal to the position shown in FIGS. 9, 11, 15, 17 and 19. This will cause the mercury to flow to the opposite side of the switch 10, thereby closing the electronic circuit and causing the signal to be triggered. The switch 10 is generally aligned in parallel relation to the first side 22 of the switch holder 20. Therefore, when the switch holder 20 is mounted to the door 12 of a side mount mailbox, the switch 10 will be positioned at an angle of approximately 30° to the horizontal when the door 12 is closed as shown in FIG. 6 and 12. As the side mount door 12 is opened to the position shown in FIGS. 7 and 13, the switch 10 pivots past the horizontal such that the mercury flows to the other end of the switch 10 for closing the circuit. Since only a single switch holder 20 is utilized for mounting the mechanism in any of the three types of mailboxes, the part count is reduced, expense of the mechanism is reduced, and installation is simplified.

Having described the preferred embodiment, other features of the present invention will undoubtedly occur to those versed in the art, as will numerous modifications and alterations in the embodiments of the invention illustrated, all of which may be achieved without departing from the spirit and scope of the invention as defined in the appended claims.

What is claimed is:

1. A mechanism for indicating when mail has been deposited in a mail container having a pivotable door, wherein said mechanism indicates the arrival of mail by signalling when said door has been opened, said mechanism comprising:

a) a tilt switch;

b) a tilt switch holder of generally triangular form having first, second, and third sides adjacent each other, said tilt switch inserted in one side and extending generally parallel to the first side, said first side being adapted to be fixed to the surface of a door of a side mount mailbox such that the tilt switch is activated as the door of the side mount mailbox is opened, said second side being adapted to be fixed to the surface of the door of a curbside mailbox and said third side to the surface of the door of a slot mail container such that the tilt switch is activated as the door of the curbside mailbox and slot mail container is opened; and c) a signalling mechanism adapted for signalling that the door of the mail container has been opened when the tilt switch is activated, and d) visual indicators appear on the tilt switch holder for indicating which side of the tilt switch holder is to be fixed to the doors of the different types of mail containers.

2. A mechanism for indicating when mail has been deposited in a mail container having a pivotable door, wherein said mechanism indicates the arrival of mail by signalling when said door has been opened, said mechanism comprising:

a) a tilt switch;

b) a tilt switch holder of generally triangular shape having first and second sides adjacent each other and extending at approximately a sixty-five degree angle to each other, a third side connecting said first and second sides, said tilt switch inserted in one side and extending generally parallel to the first side, said first side being adapted to be fixed to either surface of a door of a side mount mailbox such that the tilt switch is activated as the door of the side mount mailbox is opened, said second side being adapted to be fixed to the door of a curbside mailbox or the door of a slot mail container such that the tilt switch is activated as the door of the curbside mailbox or slot mail container is opened;

c) a signalling mechanism adapted for signalling that the door of the mail container has been opened when the tilt switch is activated; and d) visual indicators appearing on the tilt switch holder for indicating which side of the tilt switch holder is to be fixed to the doors of the different types of mail containers.

3. A method of indicating when mail has been deposited in a mail container having a pivotable door, wherein the arrival of mail is indicated by signalling when said door has been opened, said method comprising the steps of:

a) providing a tilt switch holder adapted to be mounted to the door of the mail container, said tilt switch holder includes first and second sides adjacent each other and a tilt switch mounted with the tilt switch holder for extending generally parallel to the first side;

fixing the tilt switch holder to any one of a plurality of different types of mail container doors by b) fixing the first side to a surface of the door of said mail container when said mail container is a side mount mailbox such that the tilt switch is activated as the door of the side mount mailbox is opened;

c) fixing the second side to a surface of the door of said mail container when said mail container is a curbside mailbox, such that the tilt switch is activated as the door of the curbside mailbox is opened;

d) fixing the second side to the inside surface of the door of said mail container when said mail container is a slot mail container, such that the tilt switch is activated as the door of the slot mailbox is opened; and e) signalling that the door of the mail container has been opened when the tilt switch is activated, said sides of the tilt switch holder including indicia for indicating which side of the holder is to be fixed to the door of the different types of mail containers.

4. The invention of claim 3, wherein said first and second sides extend at approximately a sixty-five degree angle to each other.

5. The invention of claim 3, wherein said tilt switch is a mercury switch.

6. A method of indicating when mail has been deposited in a mail container having a pivotable door, wherein the arrival of mail is indicated by signalling when said door has been opened, said method comprising the steps of:

a) providing a tilt switch holder selectively mountable to the door of any one of a plurality of mail containers, said tilt switch holder includes first and second sides adjacent each other and a tilt switch mounted with the tilt switch holder for extending generally parallel to the first side;

fixing the tilt switch holder to any one of a plurality of different types of mail container doors by b) fixing the first side to either surface of the door of said mail container when said mail container is a side mount mailbox so that the tilt switch is activated as the door of the side mount mailbox is opened; or c) fixing the second side to the inside surface of the door of said mail container when said mail container is a curbside mailbox so that the tilt switch is activated as the door of the curbside mailbox is opened; and d) signalling that the door of the mail container has been opened when the tilt switch is activated, said sides of the tilt switch holder including indicia for indicating which side of the holder is to be fixed to the door of the different types of mail containers.

7. The invention of claim 6, wherein said first and second sides extend at approximately a sixty-five degree angle to each other.

8. The invention of claim 6, wherein the tilt switch holder includes a third side, wherein visual indicators are placed on the sides of the tilt switch holder for indicating which side of the tilt switch holder is to be fixed to designated surfaces of the doors of different mail containers, and wherein the tilt switch holder may alternatively be fixed to the door of a curbside mailbox on its outside surface, the third side of the tilt switch holder being fixed to the outside surface.

9. The invention of claim 8, and further comprising the steps of:

fixing the third side to the inside surface of the door of a slot mailbox that opens outwardly or fixing the second side to the inside surface of the door of a slot mailbox that opens inwardly so that the tilt switch is activated when the door is open.

10. The invention of claim 8, wherein said first and second sides extend at approximately a sixty-five degree angle to each other.

11. A method of indicating when mail has been deposited in a mailbox having a pivotable door, wherein the arrival of mail is indicated by signaling when said door has been opened, said method comprising the steps of:

a) mounting a tilt switch holder of generally triangular configuration to a predetermined surface of the door of a mailbox, said tilt switch holder includes first, second, and third sides adjacent each other and a tilt switch extending generally parallel to the first side; visual indicators appearing on the sides of the tilt switch holder for indicating which side of the tilt switch holder is to be fixed to which surface of the doors of the different mailboxes; fixing the tilt switch holder to a designated surface of the door of any one of a plurality of different types of mailboxes by;

b) affixing the first side of the said tilt switch holder to either surface of a door of a side mount mailbox such that the tilt switch is activated as the door of the side mount mailbox is opened;

c) affixing the second side of said tilt switch holder to a surface of the door or affixing the third side of the holder to the outside surface of the door of a curbside mailbox, such that the tilt switch is activated as the door of the curbside mailbox is opened;

d) affixing the second side of the holder to the inside surface of the door or the third side of the holder to the outside surface of the door of said mailbox when said mailbox is a slot mailbox, such that the tilt switch is activated as the door of the slot mailbox is opened;

e) signaling that the door of the mail container has been opened when the tilt switch is activated.

12. A method of indicating when mail has been deposited in a mail container having a pivotable door, wherein the arrival of mail is indicated by signaling when said door has been opened, said method comprising the steps of:

a) mounting a tilt switch holder of generally triangular shape to the door of the mail container, said tilt switch holder includes first, second and third sides adjacent each other and said first and second sides extending at approximately sixty-five degrees from each other, and a tilt switch in said holder extending generally parallel to the first side;

b) looking at visual indicators appearing on the sides of the tilt switch holder for facilitating fixing the appropriate side of the tilt switch holder to any one of a plurality of different types of mail container doors by;

c) fixing the first side of the tilt switch holder to either surface of the door of a side mount mail container such that the tilt switch is activated as the door of the side mount mail container is opened;

d) or fixing the second side of the tilt switch holder to the inside surface of the door of a curbside mail container or fixing the third side of tilt switch holder to the outside surface of the door of a curbside mail container, such that the tilt switch is activated as the door of the curbside mail container is opened;

e) or fixing the second side of the tilt switch holder to the inside surface of the door or fixing the third side of the tilt switch holder to the outside surface of the door of a slot mail container, such that the tilt switch is activated as the door of the slot mail container is opened;

f) signaling that the door of the mail container has been opened when the tilt switch is activated.

* * * * *